US010563469B2

(12) United States Patent
Al-Badran et al.

(10) Patent No.: US 10,563,469 B2
(45) **Date of Patent: *Feb. 18, 2020**

(54) COLLECTING DRILLING MICROCHIPS

(71) Applicant: Saudi Arabian Oil Company, Dhahran (SA)

(72) Inventors: Mohammad Saud Al-Badran, Dhahran (SA); Bodong Li, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/448,881

(22) Filed: Jun. 21, 2019

(65) Prior Publication Data

US 2019/0309587 A1 Oct. 10, 2019

Related U.S. Application Data

(63) Continuation of application No. 15/647,936, filed on Jul. 12, 2017, now Pat. No. 10,428,606.

(51) Int. Cl.
*E21B 21/06* (2006.01)
*E21B 43/08* (2006.01)
(Continued)

(52) U.S. Cl.
CPC ..... *E21B 21/065* (2013.01); *B03B 5/04* (2013.01); *B03B 5/06* (2013.01); *B07B 1/12* (2013.01); *B07B 1/4654* (2013.01); *B07B 1/4681* (2013.01); *E21B 21/003* (2013.01); *E21B 43/088* (2013.01); *E21B 43/10* (2013.01); *E21B 43/16* (2013.01); *E21B 43/34* (2013.01)

(58) Field of Classification Search
CPC ..... E21B 21/065; E21B 43/16; E21B 43/10; E21B 21/003; E21B 43/34; E21B 43/08
See application file for complete search history.

(56) References Cited

U.S. PATENT DOCUMENTS 5,490,598 A 2/1996 Adams
5,690,826 A 11/1997 Cravello
(Continued)

FOREIGN PATENT DOCUMENTS

GB 2399515 9/2004
GB 2422125 7/2006
WO 00/25942 5/2000

OTHER PUBLICATIONS

International Search Report and Written Opinion issued in International Application No. PCT/US2018/040899 dated Sep. 26, 2018, 17 pages.

*Primary Examiner* — David J Bagnell
*Assistant Examiner* — Manuel C Portocarrero
(74) *Attorney, Agent, or Firm* — Fish & Richardson P.C.

(57) ABSTRACT

Multiple wires run parallel to one another. Each of wires is spaced apart from each adjacent wire at a distance less than a width of an encased microchip. Each of the plurality of wires includes a plurality of straight segments in a plane and bent segments that connect two of the plurality of straight segments. For each of the wires, each bent segments includes a first end, a second end, and a curved portion curved away from the plane. The first end is connected to at least one of the straight segments and separated from the second end a distance greater than the width of the encased microchip. The curved portion includes a diameter greater than the width of the encased microchip.

6 Claims, 6 Drawing Sheets

(51) Int. Cl.

| | |
|---|---|
| ***E21B 21/00*** | (2006.01) |
| ***E21B 43/34*** | (2006.01) |
| ***E21B 43/10*** | (2006.01) |
| ***E21B 43/16*** | (2006.01) |
| ***B03B 5/04*** | (2006.01) |
| ***B03B 5/06*** | (2006.01) |
| ***B07B 1/12*** | (2006.01) |
| ***B07B 1/46*** | (2006.01) |

(56) References Cited

U.S. PATENT DOCUMENTS

| | | | |
|---|---|---|---|
| 5,958,236 | A | 9/1999 | Bakula |
| 6,269,953 | B1 | 8/2001 | Seyffert et al. |
| 6,290,068 | B1 | 9/2001 | Adams et al. |
| 6,325,216 | B1 | 12/2001 | Seyffert et al. |
| 6,371,302 | B1 | 4/2002 | Adams et al. |
| 6,454,099 | B1 | 9/2002 | Adams et al. |
| 6,510,947 | B1 | 1/2003 | Schulte et al. |
| 6,607,080 | B2 | 8/2003 | Winkler et al. |
| 6,629,610 | B1 | 10/2003 | Adams et al. |
| 6,722,504 | B2 | 4/2004 | Schulte et al. |
| 7,000,777 | B2 | 2/2006 | Adams et al. |
| 7,216,767 | B2 | 5/2007 | Schulte et al. |
| 7,980,392 | B2 | 7/2011 | Varco |
| 2003/0230526 | A1 | 12/2003 | Okabayshi et al. |
| 2008/0190822 | A1 | 8/2008 | Young |
| 2012/0222854 | A1 | 9/2012 | McClung, III |
| 2013/0025943 | A1 | 1/2013 | Kumar |
| 2014/0183143 | A1 | 7/2014 | Cady et al. |
| 2014/0251894 | A1 | 9/2014 | Larson et al. |
| 2015/0021240 | A1 | 1/2015 | Wardell et al. |

COLLECTING DRILLING MICROCHIPS

CLAIM OF PRIORITY

This application is a continuation of and claims priority to U.S. patent application Ser. No. 15/647,936, filed on Jul. 12, 2017, the entire contents of which are hereby incorporated by reference.

TECHNICAL FIELD

This disclosure relates to recovering solids from drilling fluids.

BACKGROUND

In hydrocarbon production, a wellbore is drilled into a geologic formation. While the wellbore is being drilled, fluid can be circulated to cool a drill-bit and flush cuttings from the wellbore. Particles, such as loss control media or encased microchips, can be added to the circulating fluid.

SUMMARY

This disclosure relates to collecting drilling microchips.

An example implementation of the subject matter described within this disclosure is a wire screen with the following features. Multiple wires run parallel to one another. Each of wires is spaced apart from each adjacent wire at a distance less than a width of an encased microchip. Each of the plurality of wires includes a plurality of straight segments in a plane and bent segments that connect two of the plurality of straight segments. For each of the wires, each bent segments includes a first end, a second end, and a curved portion curved away from the plane. The first end is connected to at least one of the straight segments and separated from the second end a distance greater than the width of the encased microchip. The curved portion includes a diameter greater than the width of the encased microchip.

Aspects of the example implementation, which can be combined with the example implementation alone or in combination, include the following. Multiple support wires can be aligned across and attached to the segments.

Aspects of the example implementation, which can be combined with the example implementation alone or in combination, include the following. The plurality of support wires can include four or more support wires.

Aspects of the example implementation, which can be combined with the example implementation alone or in combination, include the following. The distance between the first end and the second end and the diameter of the curved portion can be five millimeters or greater.

Aspects of the example implementation, which can be combined with the example implementation alone or in combination, include the following. Each bent segment can include a continuously decreasing radius that circles back toward the plane, and a third bend at the second end that brings the wire to be in-line and parallel with the plane.

Aspects of the example implementation, which can be combined with the example implementation alone or in combination, include the following. A gap between the first end and the second end can be ten percent larger than the encased microchip.

Aspects of the example implementation, which can be combined with the example implementation alone or in combination, include the following. The bent segments are a first set of bent segments and the encased microchip is a first encased microchip. The wire screen can include a second set of bent segments. Each bent segment in the second set of segments includes a third end, a fourth end, and a curved portion curved away from the plane. The third end connects to at least one of the straight segments and is separated from the fourth end by a distance greater than the width of a second encased microchip. The curved portion includes a diameter greater than the width of the second encased microchip.

Aspects of the example implementation, which can be combined with the example implementation alone or in combination, include the following. The second encased microchip is a different size than the first microchip.

Aspects of the example implementation, which can be combined with the example implementation alone or in combination, include the following. The screen can include a substantially rectangular cross-section.

An example implementation of the subject matter described within this disclosure is a method with the following features. Encased microchips are circulated down a wellbore. The microchips are capable of analyzing properties within the wellbore. The encased microchips are received at a topside facility. The microchips are separated from a circulation fluid and circulation cuttings by a screen that includes wires running parallel and equally spaced to one another and traps formed with the wires. The traps are formed with the wires and oriented perpendicular to the plurality of wires. The traps are able to receive encased microchips that are circulated in the wellbore.

Aspects of the example method, which can be combined with the example method alone or in combination, include the following. The traps can include a first bend in a wire. The bend can bend in a downward direction from a plane of the screen. The traps can include a second bend with a continuously decreasing radius that circles back toward the screen. The traps can include a third bend that brings the wire to be in-line and parallel with a plane of the screen.

Aspects of the example method, which can be combined with the example method alone or in combination, include the following. Separating the microchips can include flowing a circulation fluid through the screen prior to the fluid passing through a shaker table.

Aspects of the example method, which can be combined with the example method alone or in combination, include the following. the screen can be removed after the traps are filled. The microchips can be removed from the traps.

An example implementation of the subject matter described within this disclosure is a wellbore system with the following features. A wellbore is formed into a geologic formation. A circulation pump is capable of circulating fluid through the wellbore. A shaker table is able to separate wellbore cuttings from a circulation fluid. Encapsulated microchips are capable of being circulated through the wellbore with the circulation fluid. The system includes a screen with running parallel to one another. Each of the wires is spaced apart from each adjacent wire at a distance less than a width of an encased microchip. Each of the wires includes a multiple straight segments in a plane and multiple bent segments connecting the straight segments. For each of the wires, each bent segment includes a first end, a second end, and a curved portion curved away from the plane. The first end is connected to at least one of the straight sections and is separated from the second end by a distance greater than the width of the encased microchip. The curved portion includes a diameter greater than the width of the encased microchip. a screen mount secures the screen from at least three sides of the screen. An obstacle is positioned above the screen. The obstacle prevents a microchip from bouncing out of the curved portions.

Aspects of the example system, which can be combined with the example system alone or in combination, include the following. The screen can be mounted in the shaker table.

Aspects of the example method, which can be combined with the example method alone or in combination, include the following. The encased microchips are a first set of encased microchips and the screen is a first screen. The system can further include a second screen with traps that can catch a second set of encased microchips that are a different size than the first set of encased microchips.

Aspects of the example method, which can be combined with the example method alone or in combination, include the following. The screen can be mounted between 10° and 75° from horizontal when in use.

Aspects of the example method, which can be combined with the example method alone or in combination, include the following. Each of the curved portions can extend in a downward direction when in use.

Aspects of the example method, which can be combined with the example method alone or in combination, include the following. The screen can be positioned downstream of a shaker table.

The details of one or more implementations of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

During drilling operations, encased microchips can be circulated with a well circulation fluid. The encased microchips can be used to determine properties of the wellbore during drilling operations using, for example, one or more sensors within the microchips can read pressure, temperature, or gamma rays. In order to recover data from the encased microchips, the physical microchips can be recovered from the circulating fluid.

This disclosure discusses an apparatus and method for removing microchips from circulated drilling fluid. For example, the apparatus can be a wire screen that includes parallel wires and traps for trapping or otherwise removing the microchips. The parallel wires can be separated a distance smaller than a width of the microchips, and that smaller distance can prevent the microchips from passing through the parallel wires. The traps define openings wider than the width of the microchips enabling the microchips to enter the trap through the opening. The traps capture, trap, or otherwise remove the encased microchips from circulated drilling fluid. The traps can be formed from the wires into a scoop shape or other curved shape with an opening large enough for a microchip to enter, but smaller than most wellbore cuttings. The disclosed screen can use other configurations and materials configured to remove the microchips from drilling fluid. In some implementations, the screen can be utilized at several points in a wellbore circulation system. For example, the screen can be installed upstream, downstream, or within a shaker table or similar separation system.

Figure 1A:
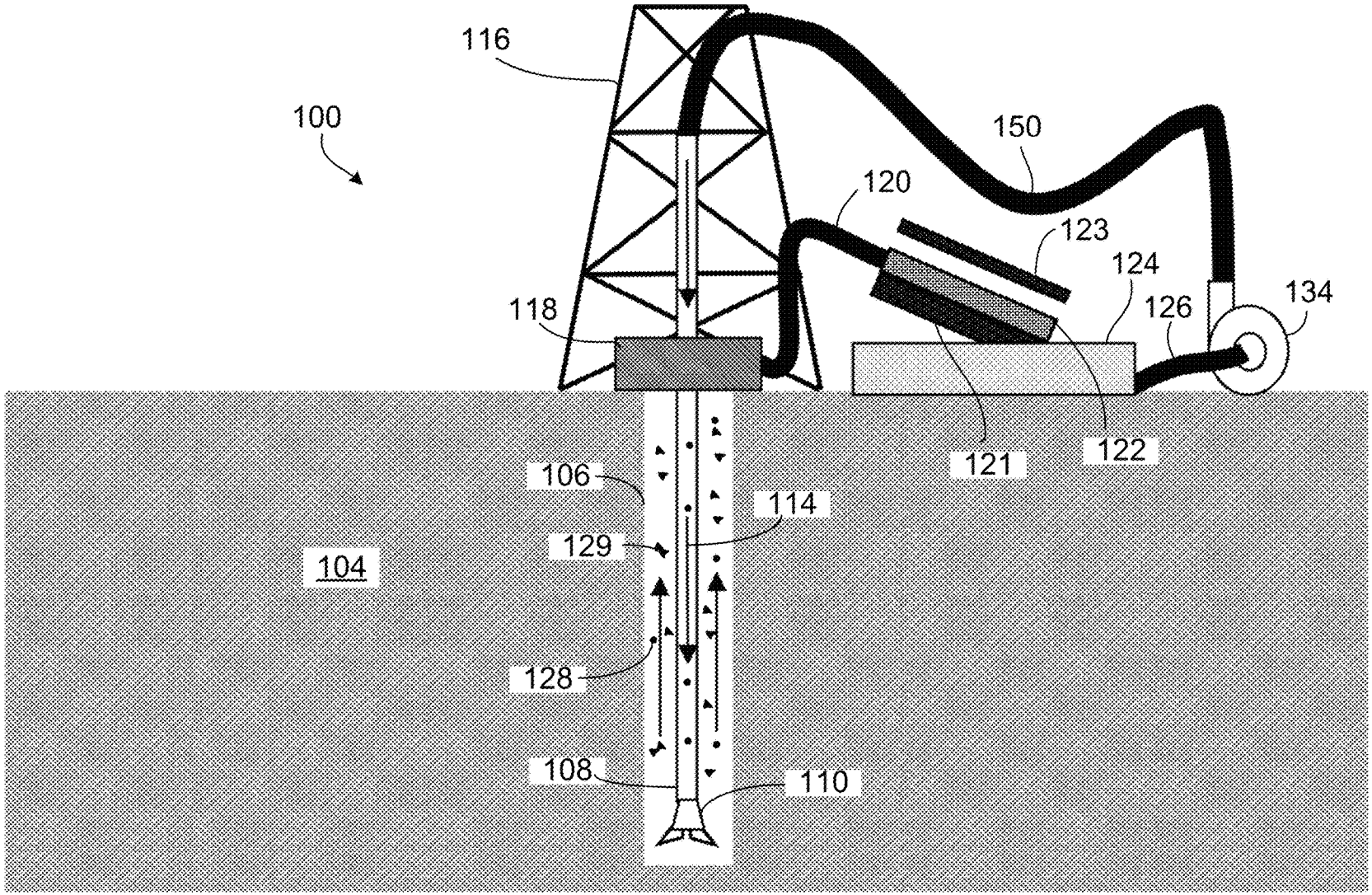
FIGS. 1A-1B are schematic diagrams of an example wellbore circulation system.
Figure 1B:
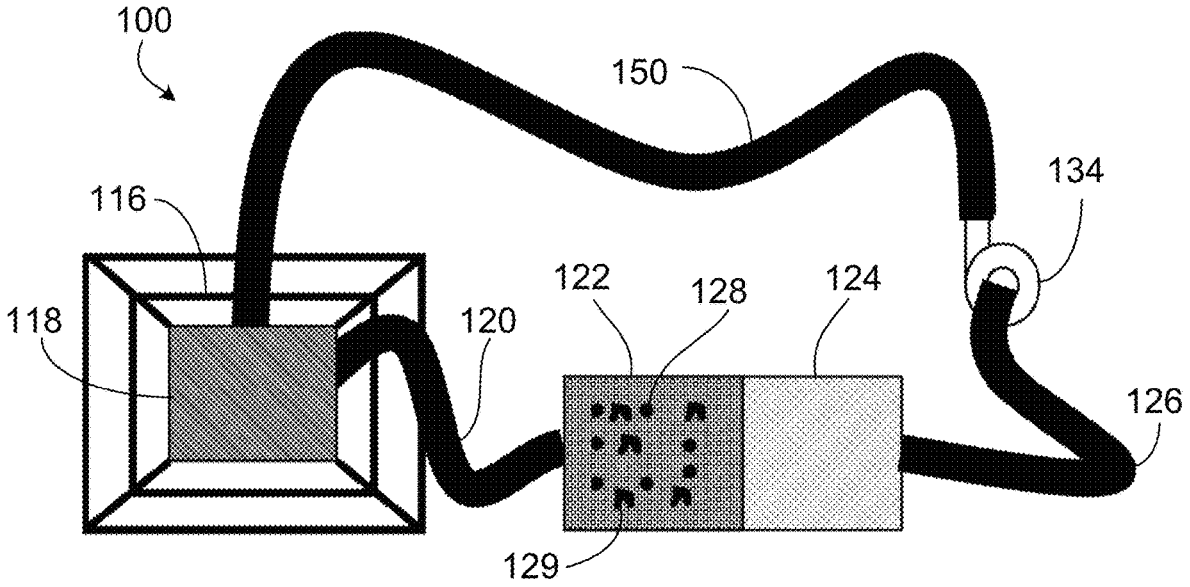

FIGS. 1A-1B show a side view and a top view of an example well circulation system 100 for removing microchips from a circulating drilling fluid in accordance with some implementations from the present disclosure. As illustrated, the well circulation system 100 includes a screen 122 configured to remove microchips 128 from circulated drilling fluid 114. In general, the drilling fluid 114 can include both wellbore cuttings 129 and microchips 128. In some implementations, the screen 122 is capable of filtering the microchips 128 from the wellbore cuttings 129 independent of human intervention. In doing so, the screen 122 can remove the microchips while allowing the drilling fluid 114 or the wellbore cuttings 129 to pass through or over the screen 122.

As illustrated, the well circulation system includes a drill derrick 116 that supports the weight of and selectively positions a drill string 108 through a blowout preventer and a well head 118 of a wellbore 106. The drill string 108 has a down-hole end connected to a drill bit 110 that drills the wellbore 106 in the formation 104. To facilitate drilling and removal of wellbore cuttings 129, a circulation pump 134 circulates the drilling fluid 114 though the wellbore 106. An inlet of a circulation pump 134 is connected to a mud pit 124 through a first pipe 126 and an exit port of the circulation pump 134 is connected to a top end of the drill string 108 through a second pipe 150. The blowout preventer 118 is connected to the screen 122 and the shaker table 121 through a third pipe 120. The mud pit 124 is connected to the screen 122 and the shaker table 121 and receives the circulation fluid 114.

As previously mentioned, the circulation fluid 114 circulates encased microchips 128. In the illustrated example, a screen 122 is designed to capture, filter or otherwise remove the microchips 128 from the circulation fluid 114. In some implementations, the microchips 128 may be wholly or partially enclosed. While the circulation system has the screen mounted in the shaker table 121, the screen 122 may be located in other locations without departing from the scope of the disclosure. For example, the screen 122 can be positioned either upstream or downstream of the shaker table 121. The screen 122 can include traps that define an opening wider than the width of the microchips 128 and smaller than a width of some wellbore cuttings 129. For example, the traps can include curved portions that define an opening wider than the width of the microchips 128. The traps may include other shapes without departing from the scope of the disclosure. In some implementations, an obstacle 123 can be positioned above the screen 122 to prevent microchips 128 from bouncing out of traps in the screen. In the illustrated example, the screen 122 is installed at an angle relative to horizontal. For example, the screen can be mounted at an angle between 10° and 75° from horizontal. The screen 122 can be mounted with a mounting system that secures the screen 122 from at least three sides of the screen 122.

During circulation, the fluid 114 is pumped from the mud pit 124 and flows through the first pipe 126 into the entry port of the circulation pump 134. The circulation pump 134 then pumps the fluid 114 from the exit port to the top end of the drill string through the second pipe 150. The drill string passes through the well head and the blowout preventer 118 and enters the wellbore 106 through the drill bit 110. After exiting the drill bit 110, the fluid 114 flows through the wellbore annulus toward the well head while carrying cuttings 129 and the microchips 128. The fluid 114 flows through the blowout preventer 118 to the screen 122 and the shaker table 121 through the third pipe 120. The screen 122 removes the microchips 128 from the fluid 114, and the shaker table 121 removes the wellbore cuttings 129. Afterwards, the drilling fluid 114 is passed to the mud pit 124. While the illustrated implementation shows a vertical wellbore, the principles of this disclosure can also be applied to a deviated or horizontal wellbore as well.

Figure 2A:
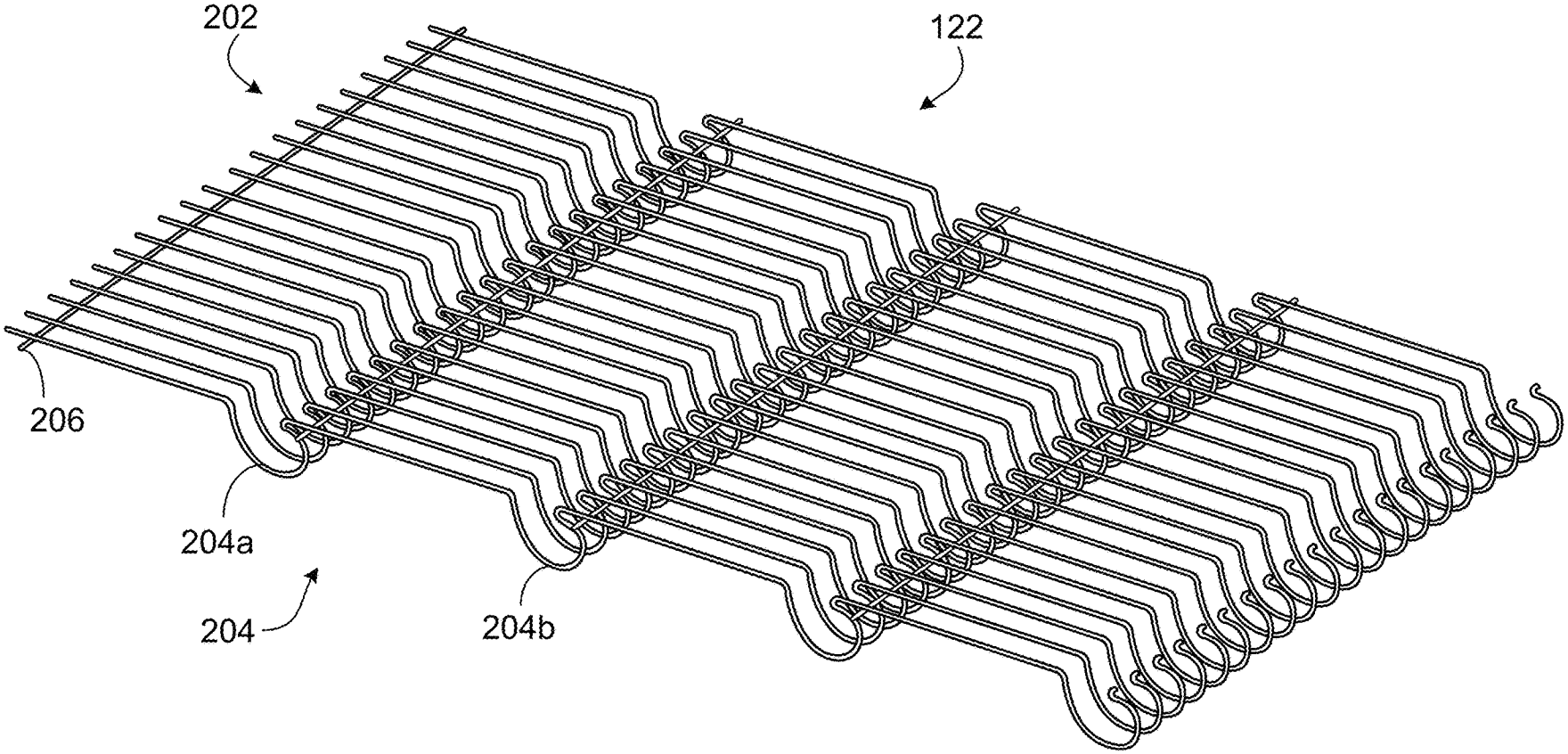
FIG. 2A is a perspective view of an example screen.
Figure 2B:
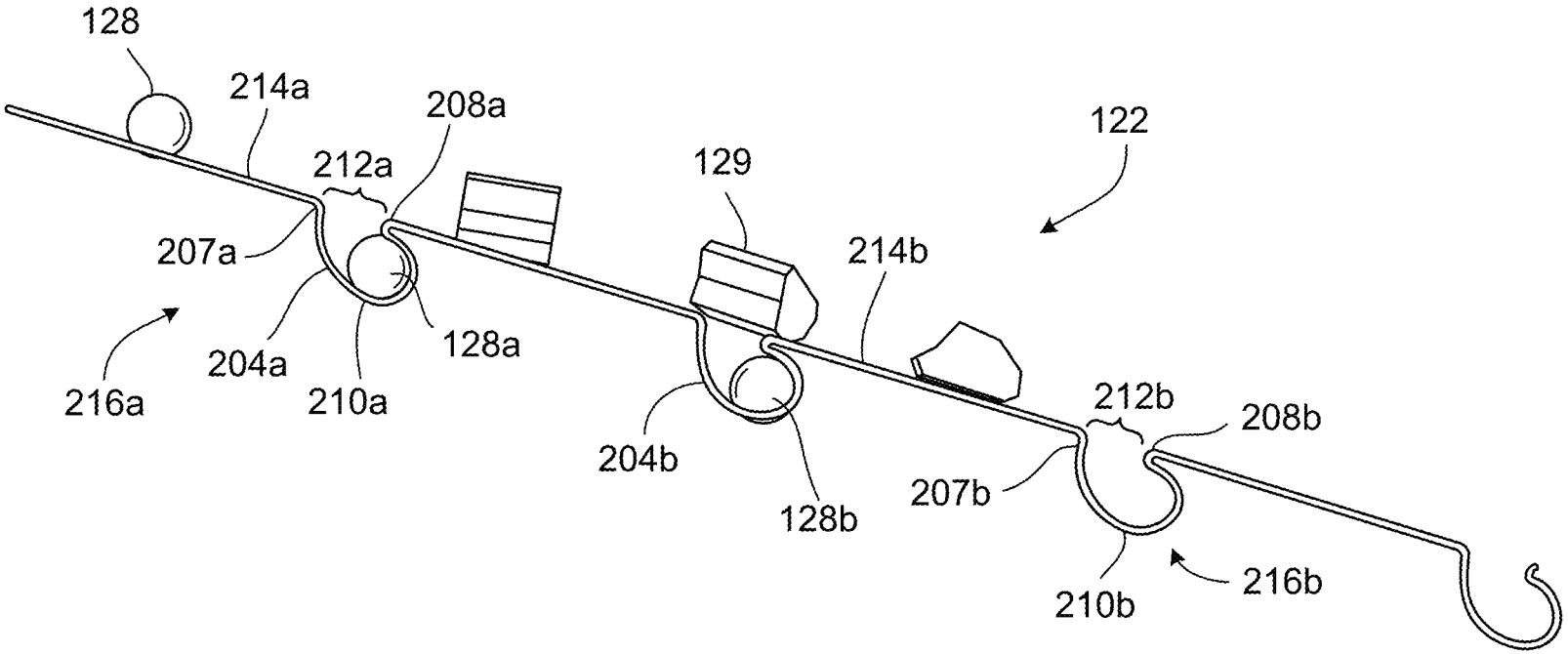
FIG. 2B is a side view of an example wire screen.
Figure 2C:
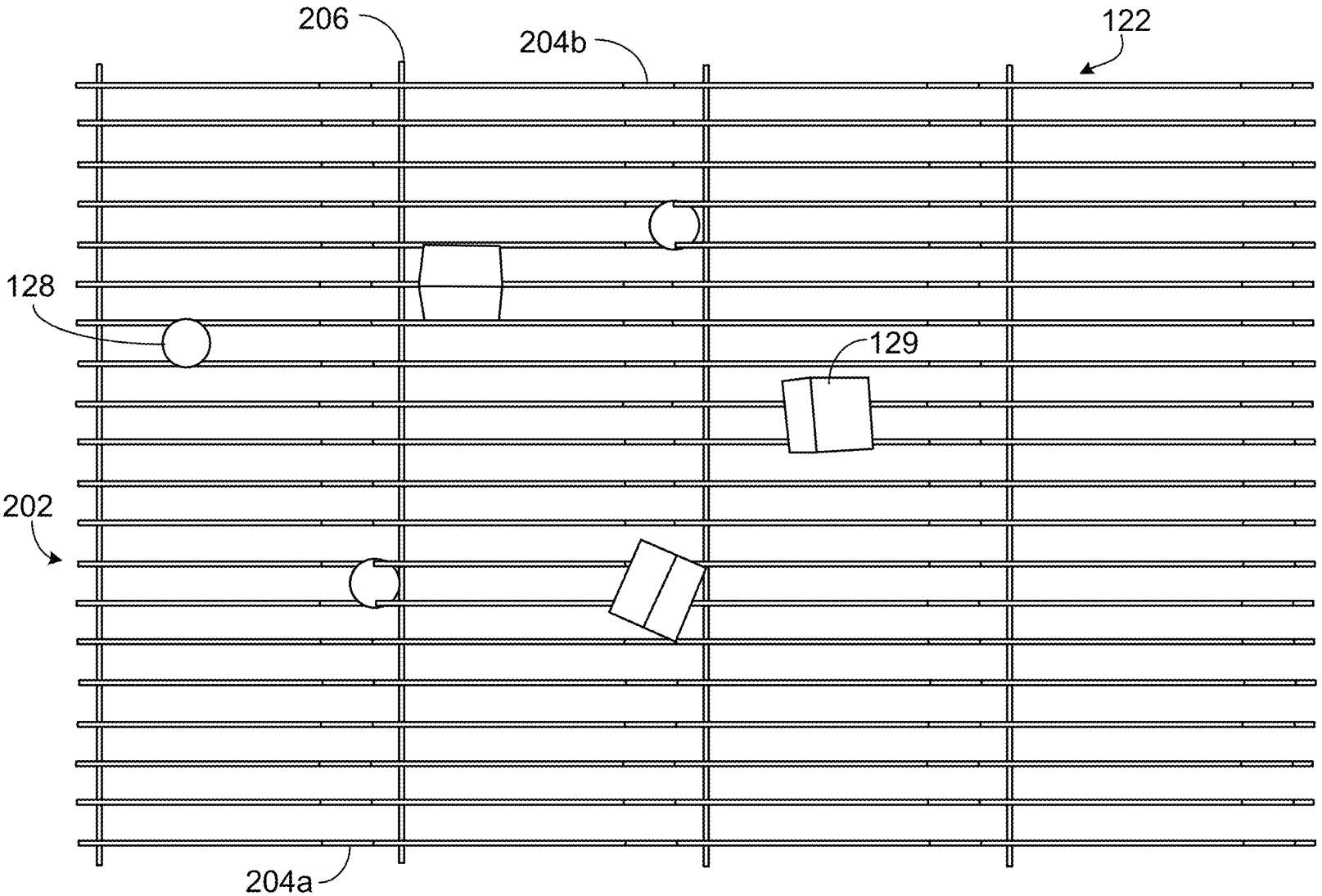
FIG. 2C is a top view of an example wire screen.

FIGS. 2A-2C show detailed views of an example screen 122 for removing microchips 128 in accordance with some implementations. Other screen configurations for removing microchips can be implemented without departing from the scope of the disclosure. The screen 122 includes multiple parallel wires 202. Each of the wires 202 is spaced apart from each adjacent wire at a distance less than a width of the microchips 128. For example, if the microchip is spherical, the distance is less than the diameter of the sphere. Each of the wires 202 includes straight segments 214*a* in a plane and bent segments 216*a* connecting the straight segments 214*a*. The bent segments 216*a* form traps 204 that are configured to capture the encased microchips 128. For each of the wires 202, each bent segment 216*a* includes a first end 207*a*, a second end 208*a*, and a curved portion 210*a* curved away from the plane of the screen 122. At least a subset is connected to the first end 207*a* and the second end 208*a* of segments 216 of the wire 202. The connected first end 207*a* and second end 208*a* are separated by a distance 212*a* that is greater than the width of the encased microchip 128. For example, the encased microchip 128 can be five millimeters in diameter, and the distance 212*a* can be 10% greater than the diameter of the encased microchip. That is, the distance 212*a* between the first end 207*a* and the second end 208*a* is five millimeters or greater. In some implementations, the distance 212*a* can allow cuttings 129 larger than the microchips 128 to pass over the traps 204 to be removed at a later step while cuttings 129 that are smaller than the microchips 128 can pass through the gaps in the wires 202.

As illustrated, the curved portion 210*a* extends in a generally downward direction when the screen 122 is installed in the system 100. Instances when the microchip 128 is spherical, the curved portion 210*a* can include a circular portion with a diameter greater than the width of the encased microchip 128. In some implementations, the diameter of the circular portion can be equal to or greater than the distance 212*a* such as five millimeters or greater.

In the illustrated implementation, the wire screen 122 includes parallel support wires 206 attached to the straight segments 214*a*. While the illustrated implementation shows the support wires 206 running transverse to the wires 202, other orientations are possible. In some implementations, four support wires 202 can be used, but more or less support wires can be used depending on the size of the screen 122, the strength of the wires 202, the shape of the screen 122, or other factors.

In the illustrated implementation, the screen 122 includes multiple traps 204. In some implementations, each bent segment 216*a* can include a continuously decreasing radius that circles back toward the plane and a third bend at the second end 208*a* that brings the wire to be in-line and parallel with the plane of the screen 122. The illustrated implementation is a single example of a bent segment 216*a* geometry that can adequately trap the encased microchips 128. Other geometries capable of capturing, trapping, or otherwise removing the encased microchips 128 while the cuttings 129 either slide over or pass through the screen 122 can be used for the traps 204 without departing from the scope of the disclosure. For example, the bent segment 216*a* can have a constant radius. In some implementations, each set of traps can have a different geometry. For example, the first trap 204*a* can have a different geometry from the second trap 204*b*. In some implementations, a separate, second screen with traps can be used. The second screen can include traps configured to catch a second set of encased microchips that are a different size than the first set of encased microchips.

In some implementations, the screen 122 can include different sized traps that can capture different sized encased microchips without departing from the scope of the disclosure. In such an implementation, a second set of bent segments 216*b* can form a second trap 204*b*. Each of the second set of bent segments 216*b* is positioned in a second set of straight segments 124*b*, includes a third end 207*b*, a fourth end 208*b*, and a curved portion 210*b* curved away from the plane. The third end 207*b* is connected to at least one of the straight sections 214*b* and is separated from the fourth end 208*b* by a distance 212*b* that is greater than the width of a second encased microchip 128*b*. The curved portion 210*b* can include a diameter greater than the width of the encased microchip 128*b*. In some implementations, some of the traps 204 can be configured to capture a different sized encased microchip. For example, the first trap 204*a* can capture an encased microchip 128*a* that is five millimeters in diameter, while the second trap 204*b* can capture an encased microchip 128*b* that is six millimeters. The traps can be configured to capture any sized encased microchip, for example, a seven millimeter encased microchip or an 8 millimeter encased microchip.

As can be easily seen in FIG. 2C, the screen 122 can include a substantially rectangular cross-section. While the illustrated implementation may include a rectangular cross section, other cross sectional shapes can also be included. For example, the screen can have a cross section that is circular shaped.

Figure 3:
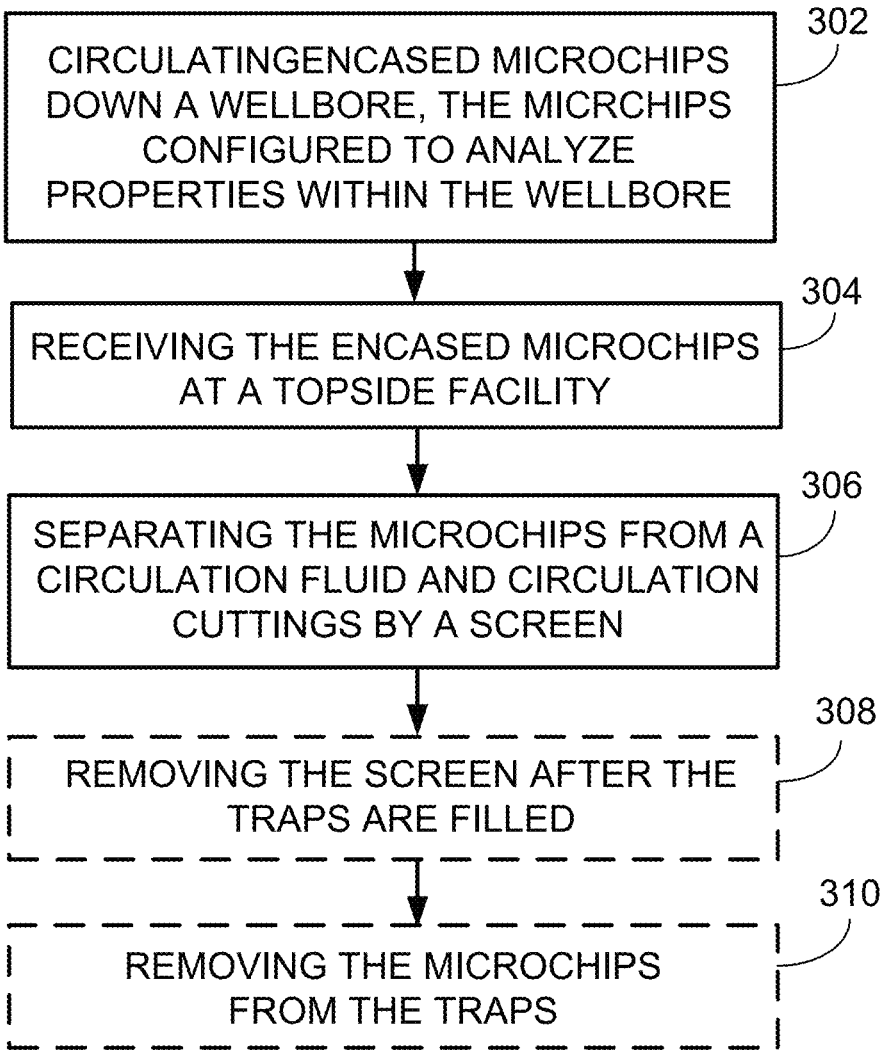
FIG. 3 is a flowchart of an example method for capturing encased microchips from a wellbore fluid.

FIG. 3 shows a flowchart of an example method that can be used to separate out the encased microchips 128 from a circulation fluid 114. At 302, encased microchips 128 are circulated down a wellbore 106. The microchips 128 can analyze properties within the wellbore, such as pressure, temperature, gamma rays, or any other downhole property. At 304, the encased microchips 128 are received at a topside facility, such as the facility shown in system 100. At 306, the microchips are separated from a circulation fluid and circulation cuttings by the screen 122. As previously discussed, the screen 122 can include wires 202 running parallel and equally spaced to one another. The screen 122 can also include traps 204 formed with the wires. The traps 204 can receive the encased microchips 128. Separating the microchips can include flowing a circulation fluid through the screen prior to the fluid passing through a shaker table. At 308, the screen 122 is removed after the traps 204 are filled. At 310, the microchips are removed from the traps. Data can then be collected from the microchips with a wireless reader.

A number of implementations of the disclosure have been described. Nevertheless, it will be understood that various modifications may be made without departing from the spirit and scope of the disclosure. Accordingly, other implementations are within the scope of the following claims.

What is claimed is:

1. A wellbore system comprising:

a wellbore formed into a geologic formation;

a circulation pump configured to circulate fluid through the wellbore;

a shaker table configured to separate wellbore cuttings from a circulation fluid;

a plurality of encapsulated microchips configured to be circulated through the wellbore with the circulation fluid;

a screen comprising:

a plurality of wires running parallel, each of the plurality of wires is spaced apart from each adjacent wire at a distance less than a width of an encased microchip, and each of the plurality of wires includes a plurality of straight segments in a plane and a plurality bent segments connecting a plurality of straight sections, at least one of the plurality of bent segments of each wire being positioned between two straight segments of the same wire; and for each of the plurality of the wires, each bent segments in the plurality of segments includes a first end, a second end, and a curved portion curved away from the plane, the first end connected to at least one of the plurality of straight sections and separated from the second end a distance greater than the width of the encased microchip, and the curved portion includes a diameter greater than the width of the encased microchip;

a screen mount configured to secure the screen from at least three sides of the screen; and an obstacle positioned above the screen, the obstacle configured to prevent a microchip from bouncing out of the curved portions.

2. The wellbore system of claim 1, wherein the screen is mounted in the shaker table.

3. The wellbore system of claim 1, wherein the encased microchips are a first set of encased microchips and the screen is a first screen, the system further comprising a second screen with traps configured to catch a second plurality of encased microchips that are a different size than the first set of encased microchips.

4. The wellbore system of claim 1, wherein the screen is mounted between 10° and 75° from horizontal when in use.

5. The wellbore system of claim 1, wherein each of the curved portions is configured to extend in a downward direction when in use.

6. The wellbore system of claim 1, wherein the screen is positioned downstream of a shaker table.

* * * * *